United States Patent [19]

Mako et al.

[11] Patent Number: 4,608,537

[45] Date of Patent: Aug. 26, 1986

[54] LOW PERTURBATION ELECTRON INJECTOR FOR CYCLIC ACCELERATORS

[75] Inventors: Frederick Mako, Fairfax Station, Va.; Wallace Manheimer, Silver Spring; Christos A. Kapetanokos, Bethesda, both of Md.; Frederick Sandel, Alexandria, Va.

[73] Assignee: The United States of America as represented by the Secretary of the Navy, Washington, D.C.

[21] Appl. No.: 620,646

[22] Filed: Jun. 14, 1984

[51] Int. Cl.[4] ..... H05H 11/00; H05H 7/08

[52] U.S. Cl. ..... 328/237; 328/233; 328/228

[58] Field of Search ..... 328/237, 233, 228; 315/85

[56] References Cited

U.S. PATENT DOCUMENTS

| | | | |
|---|---|---|---|
| 2,533,859 | 12/1950 | Wideröe | 328/237 X |
| 3,260,877 | 7/1966 | Lucas | 328/237 X |
| 3,325,713 | 6/1967 | Seidl et al. | 328/237 X |
| 3,510,713 | 5/1970 | Bennett | 328/228 X |
| 4,421,713 | 12/1983 | Manheimer et al. | 376/127 |

*Primary Examiner*—David K. Moore
*Assistant Examiner*—Vincent DeLuca
*Attorney, Agent, or Firm*—Robert F. Beers; Sol Sheinbein; Ansel M. Schwartz

[57] ABSTRACT

A tapered z-pinch for externally introducing an electron beam into a particle accelerator that causes only a small development of perpendicular velocity in the electrons of the electron beam, and that causes only a small disturbance to the magnetic field lines of the particle accelerator.

7 Claims, 8 Drawing Figures

$B_\psi$ at the radial edge (at 2 cm) of the plasma current density.

Transverse particle velocity vs. axial position when the taper length is 22 cm

Transverse particle velocity vs. axial position when the taper length is 2.2 cm

CURRENT DENSITY PROFILE
SCHEMATIC OF TAPERED Z-PINCH

MAXIMUM TRANSVERSE PARTICLE VELOCITY VS. TAPER LENGTH
$B_z = 2kG$, $B_x = 0.7kG$ and $B_\psi = 2kG$ at a radius of 2cm. Initial $\gamma_z = 7$, $\gamma_\perp = 0$.

LOW PERTURBATION ELECTRON INJECTOR FOR CYCLIC ACCELERATORS

BACKGROUND OF THE INVENTION

This invention relates to transporting electron beams without disturbance, and more particularly to a means of transporting an electron beam across magnetic field lines without adding much perpendicular velocity to the electrons.

Presently, there is substantial interest in increasing the electrical current limits of the conventional betatron. Several of these new approaches require at least a large toroidal magnetic field for the higher circulating currents and still require an inductive electric field for electron acceleration.

In the conventional betatron, electron production or injection is done inside the toroidal vacuum chamber. With this conventional injection technique a very large injection energy (greater than or equal to one Mev) is required in order to achieve the desired current levels (several kiloamperes). There are three problems with high energy internal injection. First, it requires a large opening in the torus, which introduces large electric and magnetic field perturbations and consequently disturbs the circulating electron beam. Second, the electron beam producing diode produces gases and plasma which can have adverse effects on the beam. Finally, it requires an injector with a short fall time pulse to avoid perturbing the beam after the first revolution.

To avoid the difficulties of internal injection the electron producing diode must be located external to the vacuum chamber (external injection). The difficulty with external injection is that the electron beam must now cross magnetic field lines without disturbing the electrons and specifically without adding perpendicular velocity to the electrons. Prior means for transporting electron beams across field lines are; 1) electrostatically charged and current driven axial wires, 2) exploding wire channels, 3) laser in itiated current driven channels, 4) magnetically shielded channels and 5) Z-pinch, channels. These schemes provide a means for electron beam transport, however, they all substantially perturb the electrons either during transport in the injector or when the electrons are circulating in the torus. Approach 4 is the only scheme that substantially perturbs the electrons in the torus.

SUMMARY OF THE INVENTION

Accordingly, one object of this invention is a method and apparatus to transport an electron beam across magnetic field lines which does not substantially perturb the electron beam or the external magnetic field lines.

Another object of this invention is to transfer electrons across magnetic field lines that minimizes the growth of the electrons perpendicular velocity.

Another object of the invention is to produce a tapered plasma current density through which an electron beam can travel in order to cause minimal growth of the electrons perpendicular velocity.

Still another object of the invention is to minimize the first derivative and the second derivative of the tapered plasma current density profile through which an electron beam will travel.

Yet another object of this invention is to provide a low inductance current path so the rise time of the plasma current can be minimized.

Another object of the invention is to produce a localized azimuthal magnetic field that is magnetically neutral at all points outside the localized azimuthal magnetic field region and in the localized region is larger than an external transverse magnetic field in order to cause an electron to go through the external magnetic field.

Another object of the invention is to inject an electron beam into a particle accelerator while minimizing the velocity perturbation of the electron beam as it passes through an external magnetic field region of the particle accelerator and which minimally effects the external magnetic field of the particle accelerator.

Briefly. the above objects are realized by an apparatus for conducting an electron beam through a high intensity section of an external magnetic field comprising a first region for conducting an electron beam through the high intensity external magnetic field, a means for producing a tapered current density having a localized azimuthal magnetic field within said first region, and a means for injecting an electron beam into the first region so the electron beam will be axially conducted through the tapered current density means. The first region is magnetically neutral at all points outside of the first region and is located in and on both sides of the high intensity section of the external magnetic field. The localized azimuthal field is greater than the external field's transverse component within the region of the localized field. The tapered current density means is located in the first region in such a way that the tapered current density begins and ends on opposite sides of the high intensity section of the external magnetic field.

DESCRIPTION OF THE PREFERRED EMBODIMENTS

A z-pinch, as it is known traditionally, refers to a cylinder that has current flowing in an axial or z direction. The term pinch refers to the radial compressing or pinching phenomena that occurs in a cylindrical-like structure when a very large current flows axially in the structure. While the pinching phenomena is of minor concern in the present invention and in fact is not desired, the invention is primarily concerned with a current flowing in the axial or z direction in a cylindrical device and so references the traditional terminology. More specifically, the present invention pertains to minimizing the perpendicular electron velocity perturbation of an electron beam as it is conducted through an external magnetic field by a current density that is tapered at either end and which flows axially through a cylindrical device. This tapered current density is the new and critical element that is necessary for reducing the perpendicular electron velocity perturbation of an electron beam as it is conducted by the cylindrical device through an external magnetic field with a transverse magnetic field component.

The primary purpose of this invention is to conduct an electron beam through an external magnetic field of a particle accelerator and into a vacuum vessel of the same with as little disturbance or perturbation as possible to either the external magnetic field or the electron beam. By keeping the perpendicular velocity perturbation in the electron beam small, the electrons in the electron beam are not deflected away from the vacuum vessel and also, once the electrons are in the vessel they will remain in the vessel. Similarly, by keeping the perturbation of the external magnetic field small the electrons or ions already in the vacuum vessel will remain stable and not leak out of the vacuum vessel.

A tapered current density inside a coaxial conductor results in a neutral magnetic field outside the coaxial conductor and causes no disturbance to an external magnetic field. This result of external magnetic field cancellation is just a consequence of the laws of electromagnetics as they apply to a coaxial conductor with a current density in the center flowing opposite to the direction of the current flowing in the surrounding conductor.

Figure 1:
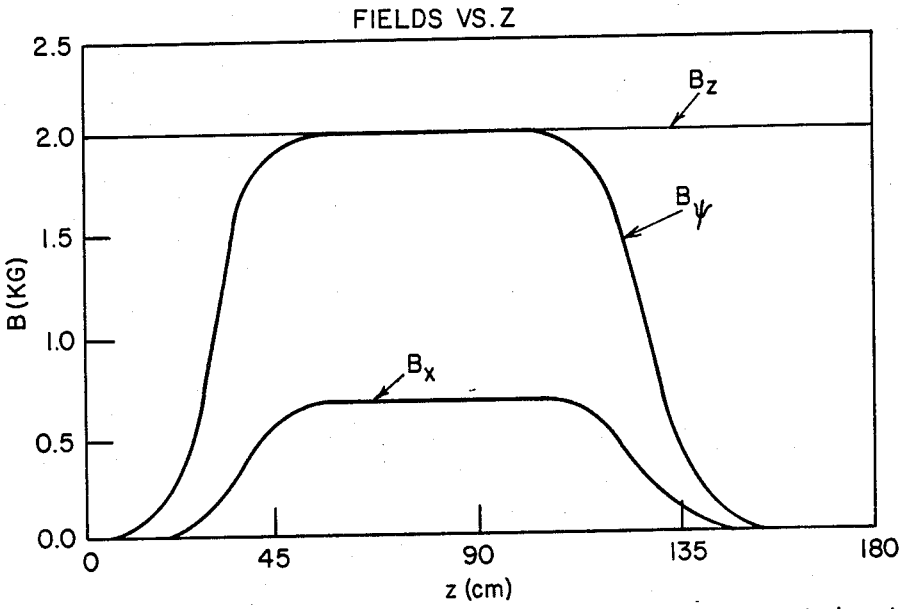
FIG. 1 is a graph of the magnetic fields inside the tapered z-pinch.
Figure 2:
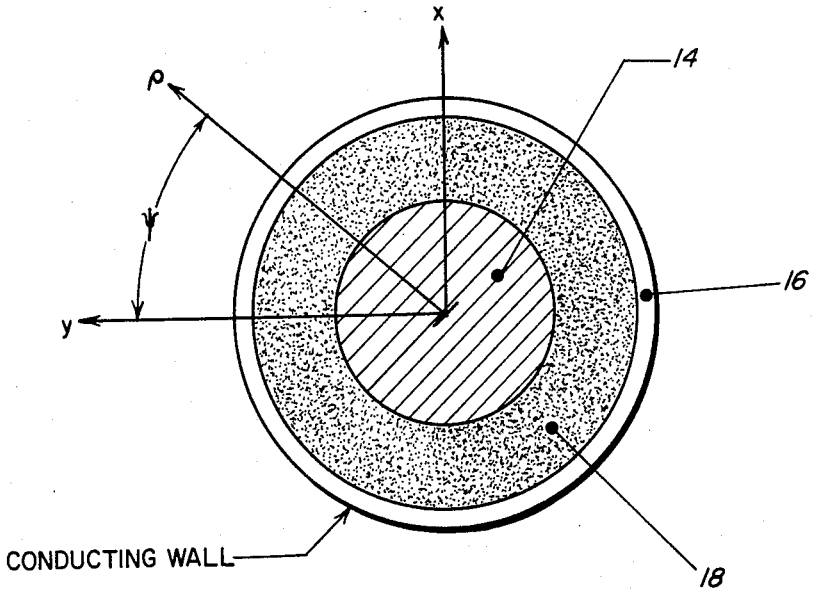
FIG. 2 is a depiction of the tapered z-pinch coordinate system as it applies to the tapered z-pinch (end view).

The existence of a current density is what gives the electrons the ability to cross the external magnetic field. Referring to FIG. 1, it is graphically depicted how the azimuthal magnetic field $B\psi$ of the current density is maintained at a strength greater than the transverse, or $B_x$, field all along the z axis (o, the origin in FIG. 1, is where the electron is first injected into the coaxial cylinder). The $B_x$ field that is depicted in FIG. 1 is derived from the superposition of the $B_x$ field that is produced from the coaxial conductor (which should be as close to zero as possible) and more importantly from the $B_x$, or transverse component that exists due to the external toroidal magnetic field. The $B_x$ field is what acts to deflect the electrons out of their desired path. By maintaining the $B\psi$, or localized azimuthal field, at a greater strength than the $B_x$ field at all positions in the coaxial conductor with a current density, the $B\psi$ field overrides the effect of the $B_x$ field and imposes instead the effect of causing the electrons to stay more closely along their desired path with only minimal perpendicular deflection due to the $B_x$ field. The coordinates of the system may better be understood if reference is made to FIG. 2. FIG. 2 is a cross-section of the tapered Z-pinch from a view looking down the axis or Z direction. As is shown in the diagram, the coordinate axis x is straight up, the coordinate axis y is 90 degrees to the left of the x axis, and z is coming out of the paper according to the right hand rule. The radius $\rho$ is measured outward from the origin of the coordinate system with the angle $\psi$ measured clockwise from the y axis. The origin is located in the center of the external coaxial conducting pipe 16. Inside the pipe 16 is an electrically resistive sleeve 18 which is in contact with the pipe 16 and which in turn surrounds a gas filled insulating sleeve 14.

The tapered aspect of the tapered current density is also essential to preventing a large increase of the electrons transverse velocity. If the electron is suddenly injected into a large azimuthal field, large velocity perturbations will manifest themselves in the subject electron. But if an electron is injected into a large azimuthal field, and instead passes into the large azimuthal field by way of a gradually increasing azimuthal field, then little if any perturbation occurs to the electron. The tapered current density supplies the requirement of a gradually increasing azimuthal field. (The same result occurs when an electron leaves a large azimuthal field, and so a gradually decreasing azimuthal field is needed at such a location). The tapered current density is very small at first and then gradually slopes up to the desired strength for $B\psi$. Again, it should be noted as shown in FIG. 1 that the $B\psi$ field is always larger than the $B_x$ field in the localized region of the coaxial conductor with a current density. More specifically the first derivative or the change of the tapered current density needs to be small and, the change in the change of the current density, or the second derivative of the tapered current density also needs to be small. Thus, the current density shields the electron beam from the external magnetic field, and the tapered aspect of the current density allows the electron beam to enter and leave the shielding current density without being perturbed.

Figure 4:
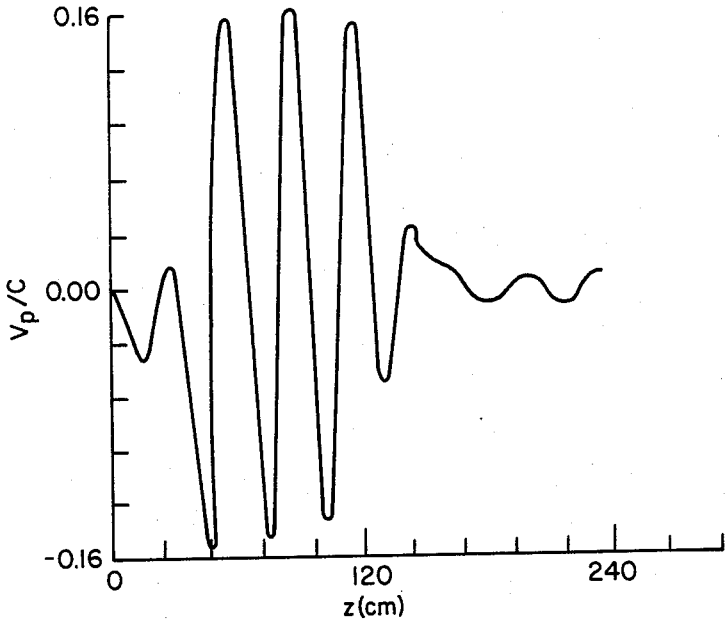
FIG. 4 is a graph of the perpendicular velocity divided by c of an electron in the tapered z-pinch with a large taper.
Figure 3:
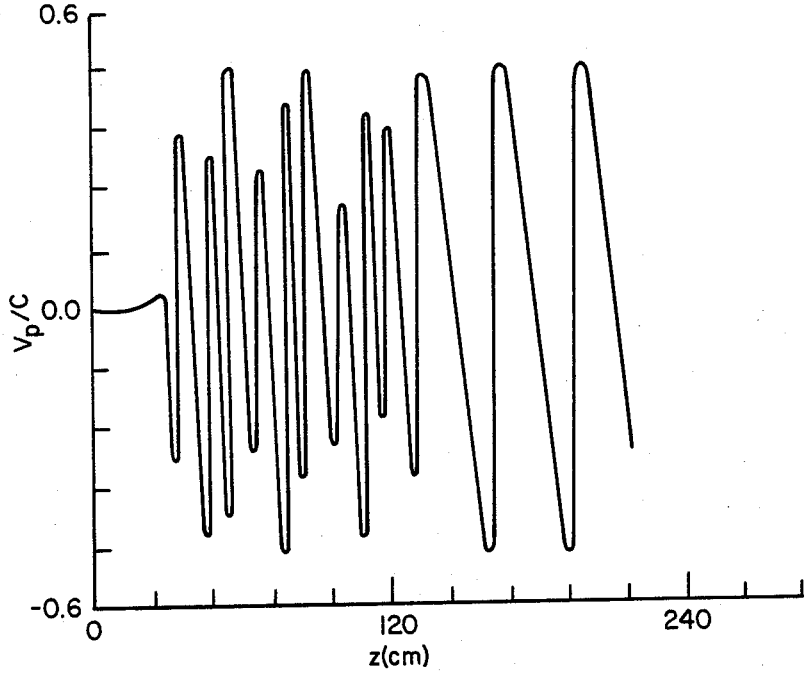
FIG. 3 is a graph of the perpendicular velocity divided by c (the speed of light) of an electron in the tapered z-pinch with a short taper.

FIG. 3 and FIG. 4 graphically show the difference in the resultant perpendicular velocity perturbation when a short-tapered current density is used, and a more gradually tapered current density is used, respectively. The horizontal axis in both FIGS. 3 and 4 is a function of distance along the z axis from o, or where an electron is injected into the current density. The perpendicular velocity $V_p$ is divided by the speed of light c in a vacuum, and forms the vertical axis in both FIGS. 3 and 4. In FIG. 3 the taper length from 10–90% amplitude is 2.2 cm. In FIG. 4, with the same parameters, the taper length is 22 cm.

The current density flows through a plasma that is located in the coaxial region inside the coaxial conductor. The plasma acts as a conductor that allows current to flow through it and at the same time allows an electron beam to pass effectively through it.

Figure 5:
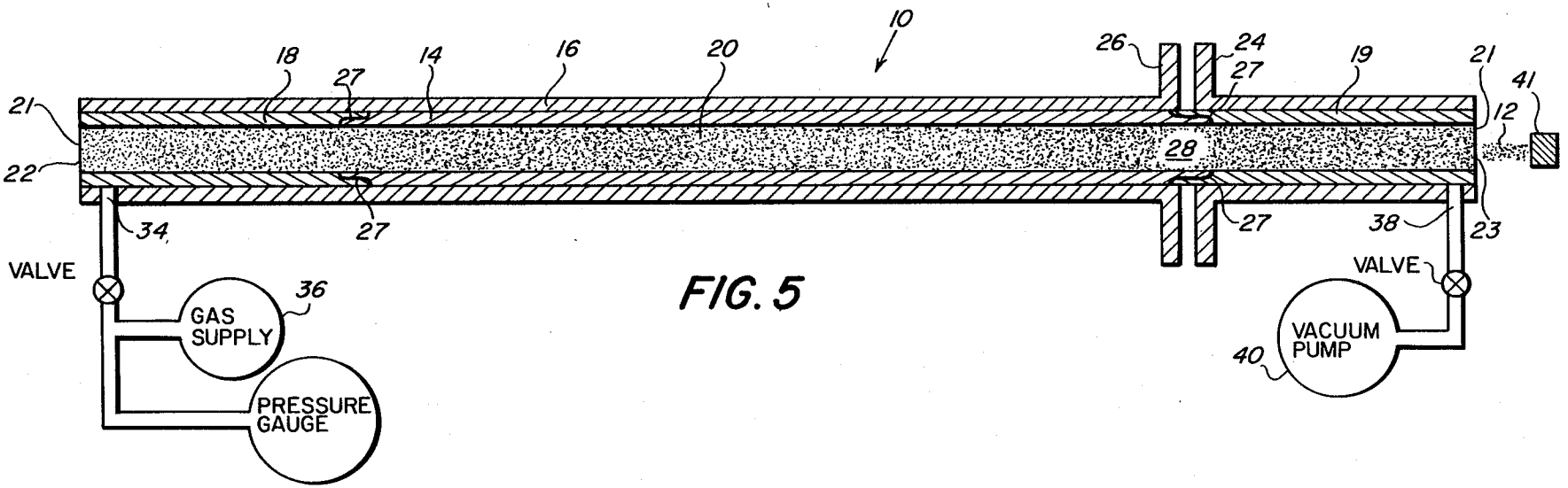
FIG. 5 is a schematic drawing of a resistive taper.

One embodiment that results in a tapered z-pinch 10 is shown in FIG. 5. An electron beam 12 is injected into a tapered z-pinch 10, which includes a long gas filled insulating sleeve 14 with an external coaxial conducting pipe 16 and electrically resistive sleeves 18 and 19 at each end of the insulator 14. To prevent gas (that is a basic for the plasma 20) from leaking, thin insulating foils 21 are used to cover the outside faces 22, 23 of the resistive sleeves 18, 19. Also, the resistive sleeve 19 located at the far end (from where electrons enter into the tapered z-pinch 10) is electrically connected to the outer conducting pipe 16. The tapered plasma current density is produced by electrically grounding the outer conductor 16 and applying a high voltage to the resistive sleeve 19 which is located nearest to the point 23 where electrons are injected into the tapered z-pinch 10. Current flows radially and axially from the entire interior surface of resistive sleeve 19 to the resistive sleeve 18, thus forming an axially tapered current density at both ends (bottom of FIG. 7) of the z-pinch 10. Also, in order to not require an excessive voltage to breakdown the gas and form the plasma current, a means for preionization of the neutral gas is used. The simplest means for pre-ionization is accomplished by bringing the high voltage and ground electrodes 24 and 26 respectively, near each other and near the insulator 14. This arrangement creates a high local electric field in the gas region 28 thus pre-ionizing the gas. The high voltage and ground electrodes 24, 26 can be flanges of any shape or design that fulfills the requirement of a means for a pre-ionization region, and also fulfills the requirement of being a low inductance connection to a driving circuit (not shown) to minimize the plasma current rise time. The low induction requirement is achieved by having the current entering into the system being as close as possible to the current leaving the system.

Figure 7:
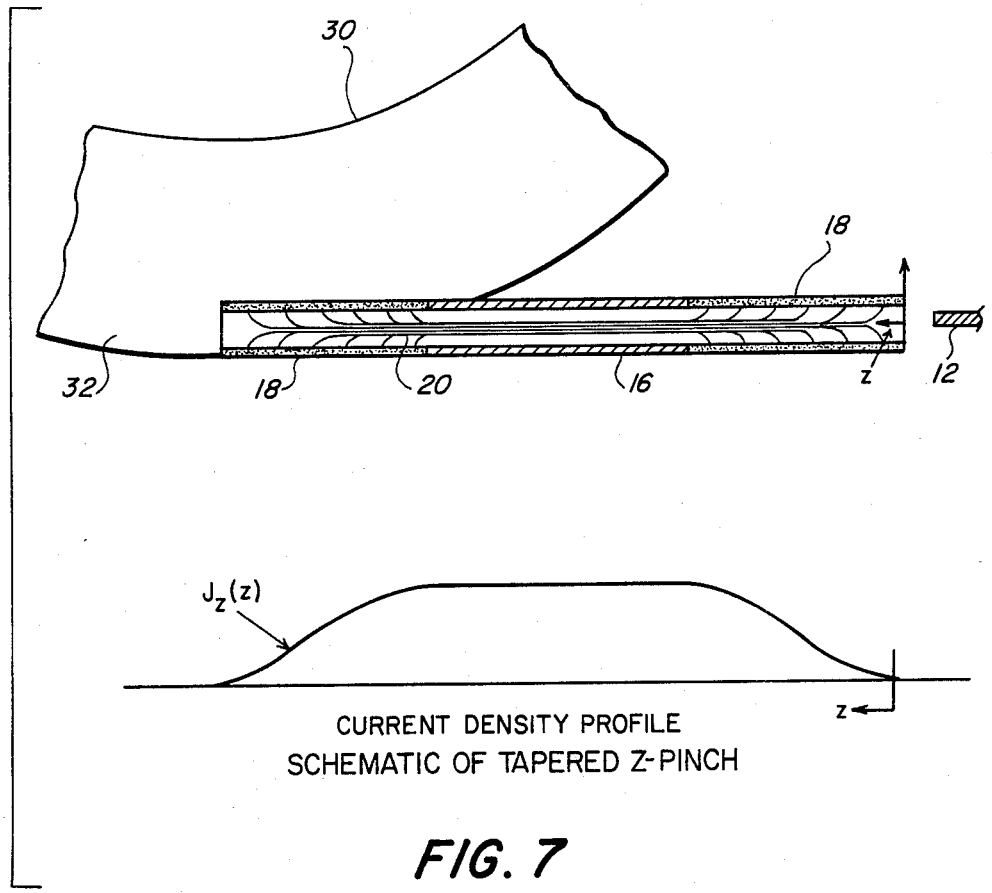
FIG. 7 is a schematic drawing of a tapered z-pinch injector in relation to a torus and a plot of the tapered plasma current density along the axis of the injector.

The tapered z-pinch (TZP) 10 in conjunction with a section of the modified betatron (MB) 30, is shown in FIG. 7 (Top). The grounded end of the TZP 10 is partially inserted tangentially into the toroidal vacuum chamber 32. With the modified betatron 30 and the TZP 10 turned on, the electron beam is then injected down the length of the TZP which carries the beam across the MB magnetic field to the interior of the MB vacuum chamber 32. When the electron beam is injected into the TZP a shield against external transverse or perpendicular magnetic fields should be in place around the beam from the point where the beam is emitted from the electron gun to where the beam enters the TZP. The shield is necessary so the electron beam will not be perturbed before reaching the protection of the TZP 10 by any external transverse magnetic fields. For instance, a coaxial tube, with a thin strip the length of the tube cut out of the tube, could be used, as well as any other well known technique for shielding against external transverse magnetic fields.

In order to keep electric and magnetic perturbations small the diameter of the TZP 10 should be small compared to the minor diameter of the MB vacuum chamber 30. Also, the conducting pipe 16 of the TZP 10 should not be magnetic, and the conductivity and radial dimensions of the conducting pipe 16 should be such that its magnetic diffusion time is long compared to the plasma current rise time and short compared to the MB field rise time. The plasma current rise time should be short compared to the time for magneto hydrodynamic instabilities.

During beam transport through the TZP 10 the beam will displace from the center by an amount given by the formula $$\frac{B_x}{B_4}\,a,$$

where Bx is the transverse component of the MB toroidal field, and $B\psi$ is the azimuthal magnetic field of the plasma current at the plasma radius a. To make the displacement small compared to the plasma radius then Bx should be small compared to $B\psi$.

To avoid an unacceptably large displacement of the plasma column the gas density should be greater than $$\frac{B_4\,B_x\,\tau^2}{4\pi\,A\,M_p\,a\,\Delta Z}\ \text{(CGS units)}$$

where A is the atomic weight of the gas, Mp the proton mass, $\Delta Z$ is the maximum allowed plasma channel displacement and $\tau$ is the time that has elapsed from the beginning of the plasma current to when the electron beam is injected. So that the gas scattering does not contribute much emittance to the electron beam the gas density should be less than $$\frac{\epsilon_N^2\,\beta^2}{8\pi\,DZ(Z+1)l\,r_e^2\,P_o^2\,\ln[a_o\,\gamma\,\beta^2/2Z^{4/3}\,r_e]}\ \text{(CGS units)}$$

where $\epsilon_N$ is the maximum allowed normalized beam emittance, l is the length of the plasma column, Z the atomic number of the gas, D=1 for the monotomic and D=2 diatomic gas, $r_e$ is the classical electron radius, $\alpha_o$ is the Bohr radius, $\beta$ is the speed of light normalized velocity of the beam electron and $\gamma$ the relativistic mass factor and $\rho o$ is the beam radius.

The gas is inserted into the TZP through a small opening 34 with a gas supply device 36 which is of known design. The gas is removed from the TZP by way of a small opening 38 with the use of a vacuum pump device 40, which is also of known design. During actual use of the TZP 10, the gas is allowed to enter the TZP 10 and reach a predetermined pressure. After such time, the gas supply device 36 is set to allow a slow leak of gas into the TZP at a rate equal to the amount of gas that is being removed by the vacuum pump device 40. In this way, gas is maintained at a constant pressure and circulated through the TZP resulting in the production of an optimal plasma. The actual creation of the plasma can be achieved by well known techniques.

Figure 8:
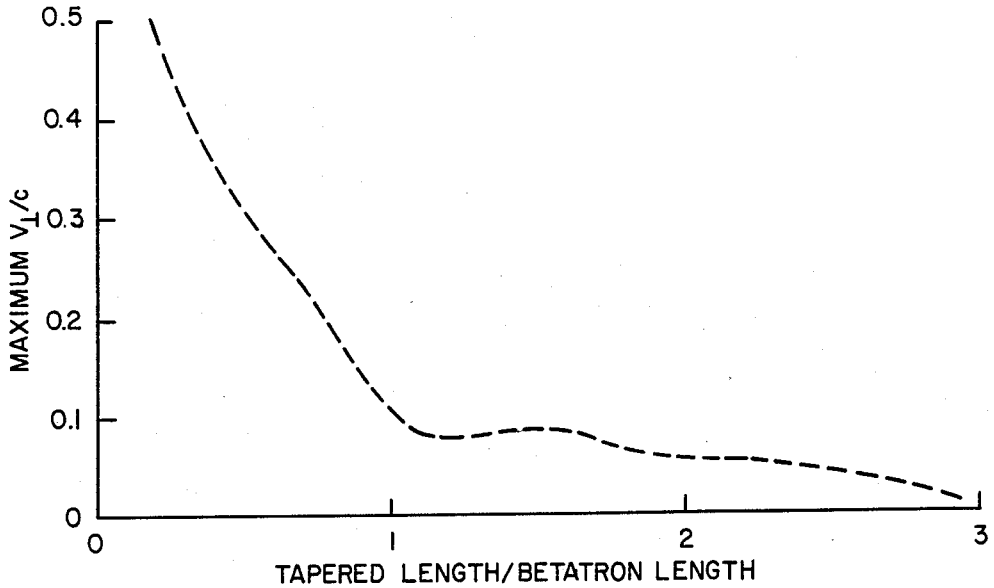
FIG. 8 is a graph of the taper length divided by the betatron wavelength and how it relates to the perpendicular velocity of an electron.

Finally, to keep the perpendicular velocity of the particles small the length of the resistive sleeve, which determines the taper length, must be large compared to the betatron wavelength of the particle which is given by $$2\pi\frac{V_o}{\Omega_z}\left[1+4\frac{V_o\Omega_4}{a\Omega_z^2}\right]^{-\frac{1}{2}}$$

where $V_o$ is the axial electron velocity, $\Omega_z$ is the gyro-frequency about the axial component of the toroidal magnetic field and $\Omega_4$ is the gyro-frequency about the maximum plasma current magnetic field. FIG. 8 shows graphically the effect that the taper length, as it is related to the betatron wavelength, has on the perpendicular velocity normalized by the speed of light in a vacuum.

An embodiment of the TZP 10 that achieves the desired results has for example, the following dimensions. The TZP 10 has a length of about 100 to 150 cm and preferably about 120 cm. The conducting pipe 16 has an I.D. of about 4 to 5 cm and preferably 4.3 cm, an O.D. of about 4.2 to 5.2 cm and preferably 4.46 cm, a length of about 50 to 70 cm and preferably about 58 cm, and is made of 304 stainless steel. The insulating sleeve 14 is about 0.2 to 0.4 cm thick and preferably about 0.3 cm thick, is made of polyethylene, a perfluorinated polymer such as teflon TM, nylon, or ceramic, and runs from resistive sleeve 18 to resistive sleeve 19 which is about 50 to 70 cm in length and preferably is about 60 cm in length. The resistive sleeves 18, 19 are about 0.5 to 2 cm thick and preferably are about 1 cm thick, and are made of Si or SiC and have a resistivity of 35–200 ohm-cm. Optimally, the resistive sleeve linearly changes its radial thickness. Starting from the insulator joint 27 with either resistive sleeve 18 or 19 and moving axially outward, the outer radius of the resistive sleeve decreases by 50%. This decrease in radius compensates for the increase in inductance due to the resistive sleeve. The resistive sleeves 18, 19 are about 25 to 35 cm long and preferably are about 30 cm long. Also, the insulator 14 must be lap jointed and a vacuum tight bond made with the resistive sleeves 18 and 19. An overlap joint of 2.5 to 5 cm is required, preferably 5 cm, with an adhesive like epoxy or silicone rubber being used to bond the parts together. Permabond 910 epoxy can be used with nylon and ceramic. Almost any RTV silicone rubber can be used with teflon or polyethylene.

The second surrounding conducting pipe 16 is similar to the first conducting pipe but preferably is about 60 cm in length. The pre-ionization region has the high voltage and ground flanges or electrodes 14, 26 about 1 to 3 cm apart and preferably is about 2 cm apart, with the insulator 14 filling any gap created. The flanges 24, 26 that are formed to provide a path back to the driving circuit (not shown), have a size dictated by the demands of the situation. The preferable driving circuit should be a capacitor bank. The gas that forms the plasma can be, for instance, nitrogen at a pressure of 200 to 1000 millitorr. Preferably the pressure should be maintained at 500 millitorr. The thin foil 21 may have, for instance, a thickness of about between 0.1 and 0.3 mil (preferably 0.25 mil.) and be made of a plastic film such as mylar or Kaptane. The transverse magnetic field in the TZP 10 may, for example, be a maximum of 700 gauss, and the axial magnetic field may be, for instance, about 2000 gauss. The current supplied to the TZP can be, for instance, 20,000 AMPS with a 1 microsec. rise time to the peak of the current. The voltage to the TZP is, for example, 10 to 30 kilovolts. The electron beam 12, is produced by an electron gun 41 used is, for instance, a 300 kilovolt electron beam of 50 milliamps with a pulse length of 50 nanoseconds at the full-width at the half maximum point.

Figure 6:
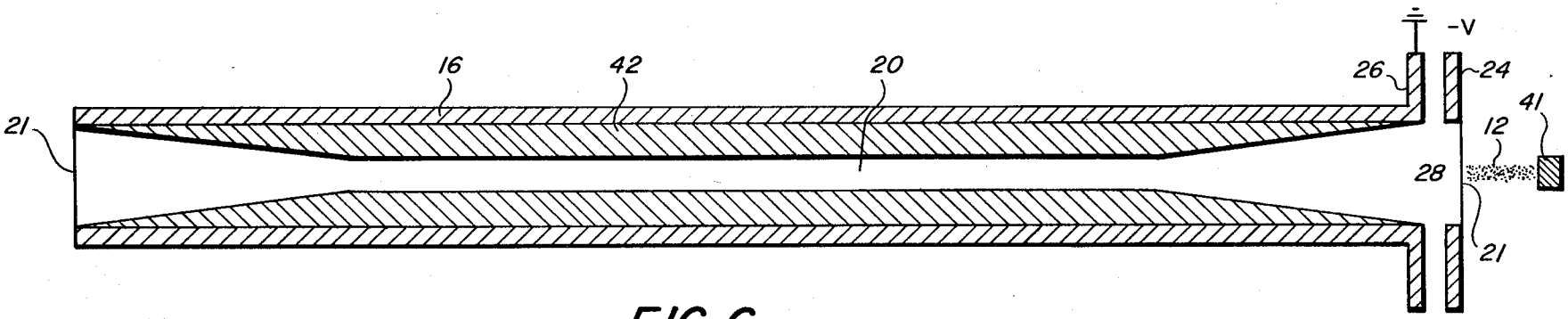
FIG. 6 is a schematic drawing of a geometric taper.

Another embodiment that can be used to achieved the desired result of a tapered current density is the geometric taper shown in FIG. 6. The geometric taper achieves a tapered current density with the use of an insulation sleeve 42 that is angled at its ends and linear in the middle. The geometric taper has a coaxial conducting pipe 16, thin foils 21 to close off the conducting pipe 16 and maintain a gas therein, and a preionization region 28 formed by high voltage and ground flanges 24, 26, respectively.

Obviously, numerous (additional) modifications and variations of the present invention are possible in light of the above teachings. It is therfore to be understood that within the scope of the appended claims, the invention may be practiced otherwise than as specifically described herein.

What is claimed as new and desired to be secured by letters patent of the United States is:

1. An apparatus for conducting an electron beam through a high intensity section of an external magnetic field, said high intensity section having a first side and a second side and being disposed therebetween, comprising a first region for conducting an electron beam through said high intensity external magnetic field, said first region being located in and running through the high intensity section of the external magnetic field from the first side to the second side thereof;

means for producing a tapered current density having a localized azimuthal magnetic field within said first region, said localized azimuthal field being greater than said external field's transverse component within the first region;

said tapered current density means located in the first region in such a way that the tapered current density begins on the first side and ends on the second side of the high intensity section of the external magnetic field, said tapered current density means being magnetically neutral outside the first region;

and means for injecting an electron beam into the first region so the electron beam will be axially conducted through the tapered current density means.

2. An apparatus as described in claim 1 wherein the tapered current density means is a tapered z-pinch.

3. An apparatus as described in claim 2 wherein the tapered z-pinch is comprised of a first coaxial conducting pipe having a flange end and a second coaxial conducting pipe having a flange end;

said flange end of first coaxial conducting pipe facing said flange end of second coaxial conducting pipe so a pre-ionization region and a low inductance connection is formed;

a first resistive sleeve, a second resistive sleeve, and an insulating sleeve;

the first resistive sleeve lining the first coaxial conducting pipe, and the insulating sleeve lining the second coaxial conducting pipe from the end of the first resistive sleeve located at the flange end of the first coaxial conducting pipe to a predetermined position in the second coaxial conducting pipe whereat the second resistive sleeve lines the remainder of the second coaxial conducting pipe, said insulating sleeve being lap jointed to the first resistive sleeve and to the second resistive sleeve;

a first thin foil and a second thin foil, said first thin foil and said second thin foil covering the other ends of said first coaxial conducting pipe and said second coaxial conducting pipe, respectively.

4. An apparatus as described in claim 3 including a gas supply device for supplying gas to the tapered z-pinch through the second coaxial conducting pipe at a location near the first thin foil;

and a gas vacuum pump device that removes gas from the tapered z-pinch through the first coaxial conducting pipe at a location near the second thin foil.

5. An apparatus as described in claim 4 wherein the first resistive sleeve's and the second resistive sleeve's radial thickness linearly reduces by 50% from where said first resistive sleeve and said second resistive sleeve are lap jointed with said insulating sleeve to where said first resistive sleeve and said second resistive sleeve end, respectively.

6. An apparatus as described in claim 2 wherein the tapered z-pinch is comprised of a coaxial conducting pipe having a flange end and a coaxial disc;

the flange end of the conducting pipe facing the coaxial disc so a pre-ionization region and a low inductance connection is formed;

an insulation sleeve having angular ends with a linear portion therebetween lining the coaxial conducting pipe, a first thin foil and a second thin foil;

the first thin foil covering the other end of the conducting pipe, and the second thin foil covering the end of the coaxial disc that does not face the conducting pipe.

7. A method for conducting electrons of an electron beam through an external magnetic field of a particle accelerator with minimal perturbation of the electron, perpendicular velocity comprising the steps of:

inserting a tapered z-pinch into a vacuum vessel of the particle accelerator:

creating a plasma inside the tapered z-pinch so a localized magnetic field is created within the tapered z-pinch that has a greater localized azimuthal magnetic field than the transverse magnetic field of the external magnetic field, said tapered z-pinch having a near-neutral magnetic field outside the tapered z-pinch and;

injecting an electron beam into the tapered z-pinch so it is axially conducted through the tapered z-pinch and into the vacuum vessel.

* * * * *